US005417422A

United States Patent [19]

Hansen

[11] Patent Number: 5,417,422

[45] Date of Patent: May 23, 1995

[54] PINBALL OPTICAL ILLUSION TECHNIQUES

[76] Inventor: Bryan P. Hansen, 536 Lyman Ave., Des Plaines, Ill. 60016

[21] Appl. No.: 255,480

[22] Filed: Jun. 8, 1994

[51] Int. Cl.[6] ..... A63F 7/30

[52] U.S. Cl. ..... 273/121 A; 273/121 E; 273/119 A; 273/118 A; 273/127 R

[58] Field of Search ..... 273/118, 119, 121, 127

[56] References Cited

U.S. PATENT DOCUMENTS

| | | | |
|---|---|---|---|
| 4,840,375 | 6/1989 | Lawlor et al. | 273/121 A |
| 4,934,699 | 6/1990 | Kaminkow et al. | 273/121 A |
| 5,181,722 | 1/1993 | Krutsch et al. | 273/121 A X |
| 5,226,653 | 7/1993 | Bil et al. | 273/118 A X |
| 5,350,174 | 9/1994 | Ritchie et al. | 273/121 A |

*Primary Examiner*—Raleigh W. Chiu
*Attorney, Agent, or Firm*—Robert E. Browne; Gary R. Jarosik; Thomas C. McDonough

[57] ABSTRACT

A pinball game for creating an optical illusion in which a real pinball normally enters a saucer cup held on a stage during a first operating state, During a second operating state, the stage screens are closed and the pinball enters a lift mechanism held behind the stage. A false pinball is displayed in the saucer cup and is raised by the lift mechanism to create the illusion that the real pinball is floating in defiance of gravity. After the false pinball and the real pinball are in the loft area above the stage, the real pinball is guided to a ramp which returns the real pinball to the playfield.

18 Claims, 15 Drawing Sheets

PINBALL OPTICAL ILLUSION TECHNIQUES

FIELD OF THE INVENTION

This invention relates to a pinball machine, and more particularly relates to such machine in which the pinball is manipulated outside of the view of a pinball player.

DESCRIPTION OF THE PRIOR ART

As far as the applicant is aware, pinball optical illusion techniques of the type described in this specification are new innovations. Although pinball games have maneuvered a pinball outside of view of a pinball player in the past, the applicant is unaware of any pinball game which creates the optical illusion claimed in the accompanying claims.

SUMMARY OF THE INVENTION

There is a need in pinball games to create various illusions which hold the interest of the player and induce him to engage in successive play of the game in order to see the illusion repeated. By employing the unique techniques described in this specification, a pinball player is given the illusion that a pinball is floating in mid-air, contrary to the laws of gravity. Such techniques add to the enjoyment of the game and give the player incentive to strike a target as often as possible in order to watch the pinball "floating."

Accordingly, it is an object of the present invention to provide an improved pinball optical illusion in which a pinball appears to be floating or engaging in other gravity-defying movements.

Another object of the present invention is to provide techniques of the foregoing type that employ a stage on which the pinball can be displayed if the player is able to propel the pinball adjacent a target.

The present invention is useful in a pinball game employing a first pinball adapted to be propelled along a playfield by a player. The player may propel the ball by any convenient means, such as a pinball flipper. In such a pinball game, an optical illusion may be created for the first pinball by providing a second pinball, a target and a display area of the game visible to the player, as well as a hidden area of the game concealed from the player. The first pinball is displayed in the display area in response to the player propelling the pinball adjacent the target during a first operating state of the game. The pinball also is returned to the playfield from the display area during the first operating state.

During a second operating state of the game, the first pinball is moved within the hidden area in response to the player again propelling the pinball adjacent the target. The second pinball is then displayed in the display area and is moved from the display area to the hidden area during the second operating state. The first pinball is returned to the playfield from the hidden area after the second pinball has been moved to the hidden area during the second operating state. As a result of the foregoing techniques, the movement of the second pinball appears to the player to be the movement of the first pinball. By properly maneuvering the second pinball, it appears to the player that the second pinball is floating or undergoing other gravity defying movements.

BRIEF DESCRIPTION OF THE DRAWINGS

These and other objects, advantages and features of the invention will appear for purposes of illustration, but not of limitation, in connection with FIGS. 1–13 wherein like numbers refer to like parts throughout and in which.

DETAILED DESCRIPTION OF THE PREFERRED EMBODIMENT

Figure 1:
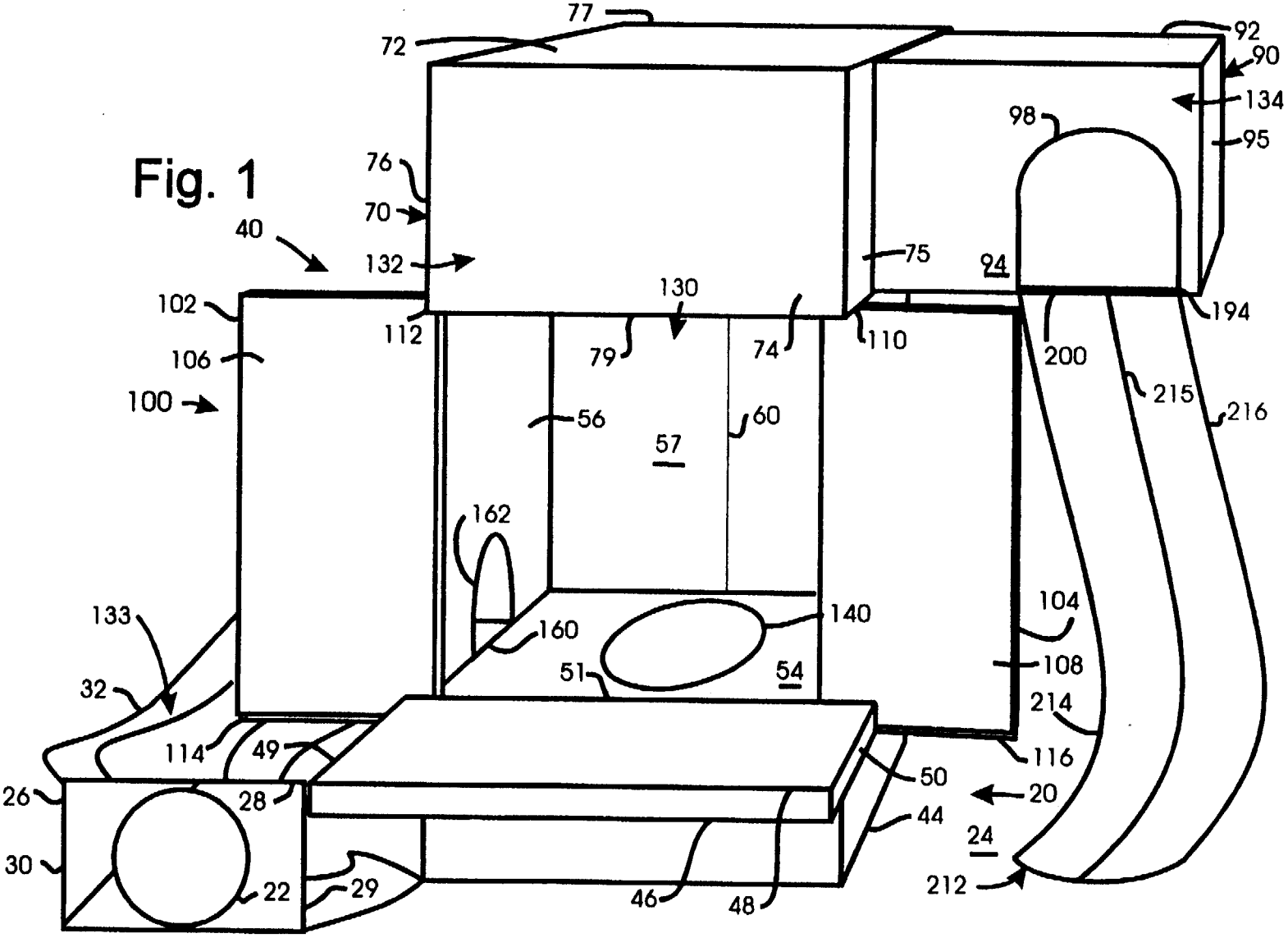
FIG. 1 is a perspective view of a preferred form of apparatus made in accordance with the present invention in the form of a stage for displaying a pinball.

Referring to FIG. 1, the preferred embodiment preferably is used in connection with a pinball game 20 employing a pinball 22 rolling on a pinball playfield 24. The player attempts to propel pinball 22 into a target 26 comprising guide walls 28–30 arranged as shown (FIG. 1). Interior portions of target 26 may be concealed from the player's view by any convenient means, such as a fabric cover 32.

Figure 2:
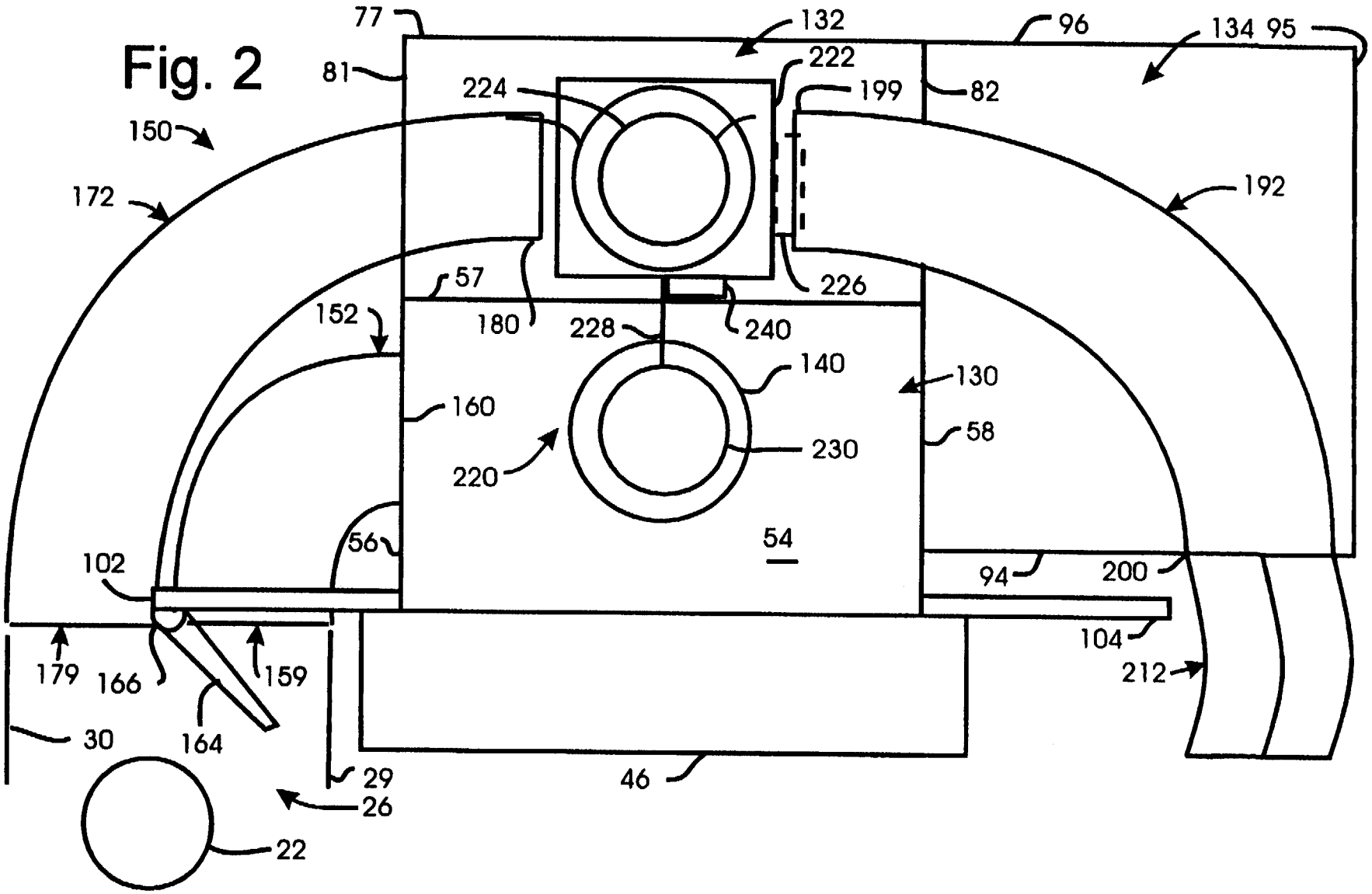
FIG. 2 is a top plan view of the apparatus shown in FIG. 1 with the covers removed.
Figure 3:
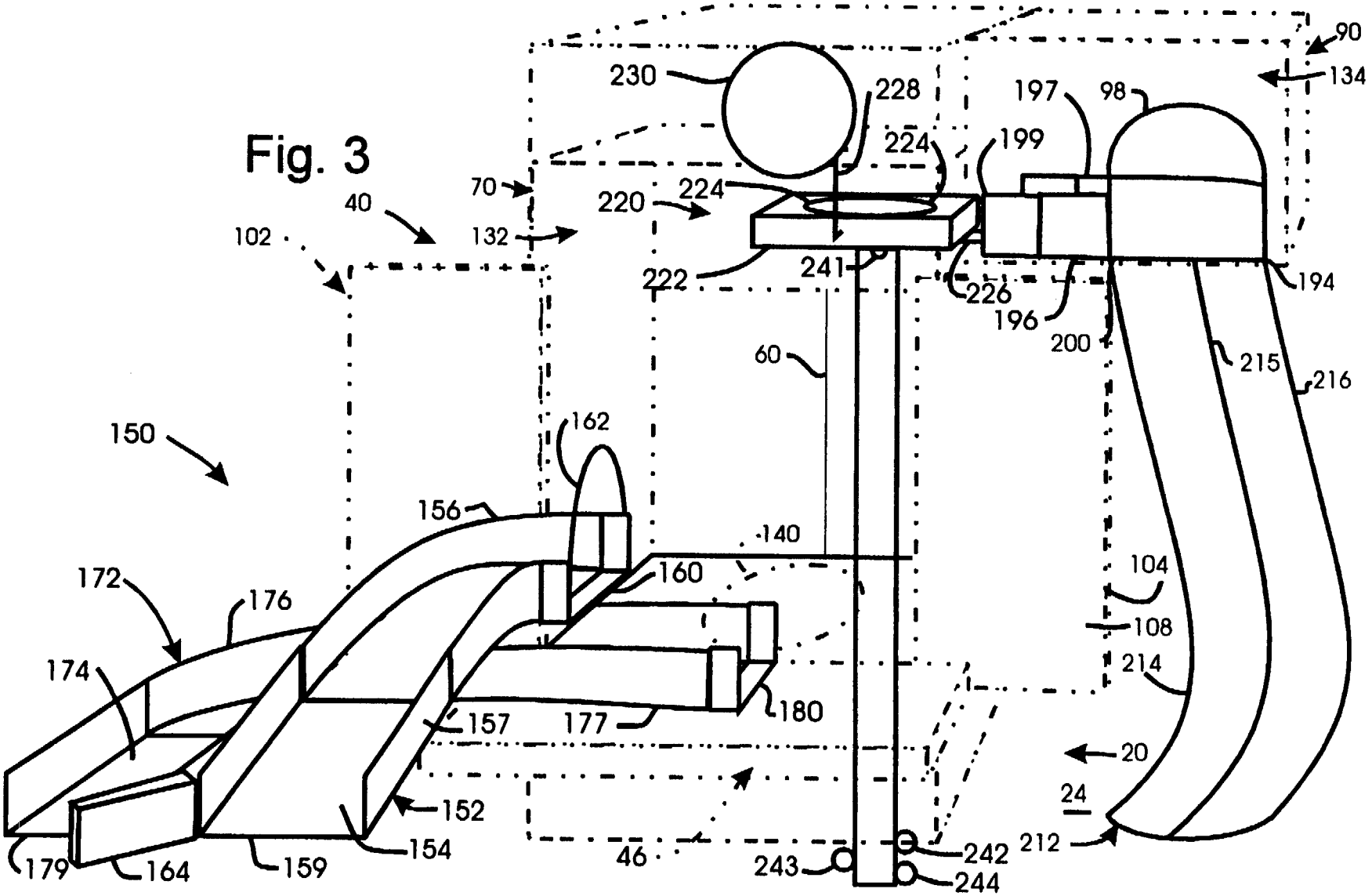
FIG. 3 is a perspective view of the apparatus shown in FIG. 1 with outer structural features shown in phantom to reveal interior features.

Referring to FIGS. 1–3, the preferred embodiment basically comprises a stage assembly 40, a guide assembly 150 and a lift assembly 220. Stage assembly 40 comprises a base 44 which is supported by playfield 24. The base carries a proscenium 46 having an upper surface 48, a left edge 49, a right edge 50 and a rear edge 51. Behind the proscenium on the same level as upper surface 48 is a rear stage floor 54. The stage floor is partially enclosed by vertical stage walls 56–58. A slot 60 bisects rear wall 57.

Stage assembly 40 also includes a loft enclosure 70 having an upper surface 72 and vertical walls 74–77. Back wall 77, as well as rear portions 81 and 82 of side walls 75 and 76, may extend downward to playfield 24 in order to conceal apparatus behind the stage area. Vertical front wall 74 has a lower edge 79.

Stage assembly 40 also includes a loft extension assembly 90 having an upper surface 92 and vertical walls 94–96 arranged as shown. Wall 94 defines a pinball opening 98 from which a pinball may exit and descend to playfield 24.

Figure 1A:
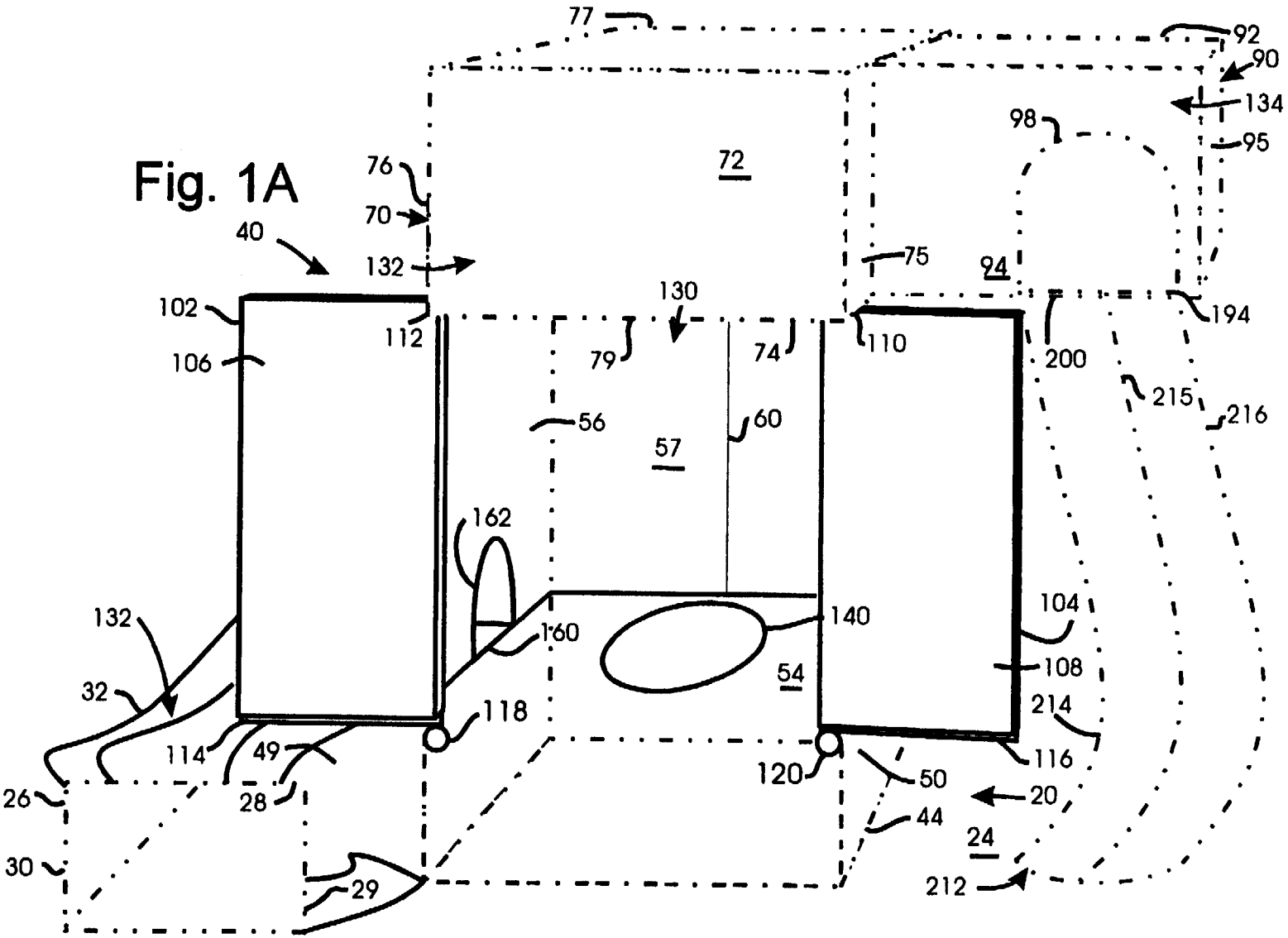
FIG. 1A illustrates the apparatus shown in FIG. 1 with the proscenium removed to reveal interior parts.

Stage assembly 40 also includes a stage screen assembly 100 having stage screens 102 and 104 that are fitted with forward surfaces 106 and 108 that may be decorated in any convenient manner. Screens 102 and 104 comprise a movable closure medium. The screens ride on rack gears 114 and 116 which are engaged by pinion gears 118 and 120 (FIG. 1A) in order to open and close the screens.

The stage assembly defines a display area 130 which extends from stage floor 54 to the lower edge 79 of loft enclosure 70 and which lies within walls 56–58 and within the vertical projection of edge 51 of proscenium 46. The stage assembly also defines hidden areas 132–134 as shown in FIGS. 1 and 2.

Stage floor 54 is fitted with a conventional saucer cup 140. As known to those skilled in the art, the saucer cup has an internal mechanism extending below floor 54 that enables pinball 22 to be ejected toward the front of the stage so that it rolls over proscenium 46 and onto a playfield 24 when activated.

Referring to FIGS. 2 and 3, guide assembly 150 includes guides 152, 172, 192 and 212. Pinball guide 152 has a flat bottom 154 and vertical side rails 156 and 157. Guide 152 includes an entrance end 159 and an exit end 160. Pinball 22 exits through arch 162 that is cut into sidewall 56. Guide 152 enables pinball 22 to travel from playfield 24 onto stage floor 54 and into saucer cup 140.

A diverter gate 164, that is pivoted around a vertical axis by means of a conventional pivot 166, can divert pinball 22 into guide 152 or guide 172.

Guide 172 includes a flat bottom 174 and vertical side rails 176 and 177. Guide 172 has an entrance end 179 and an exit end 180. Bottom 174 lies on playfield 24 and extends behind and below stage floor 54.

Guide 192 includes a flat bottom 194 and vertical side rails 196 and 197. Guide 192 has an entrance end 199 and an exit end 200.

After pinball 22 exits opening 98, it is carried back to playfield 24 by means of guide 212 comprising three wires 214–216 arranged as shown (FIGS. 1–3).

Referring to FIGS. 2 and 3, lift assembly 220 comprises a carriage 222 having a central cup 224 suitable for receiving and carrying pinball 22. A lip 226 is attached to the lower edge of carriage 222 as shown and is made to comate with end 199 of guide 192. A support wire 228 supports a second pinball 230. Carriage 222 is supported through a pivot 241 by a rack gear 240 that is driven in a vertical direction by conventional pinion gears 242–244 (FIG. 3). Lift assembly 220 is concealed in hidden area 132, except for ball 230 which extends into display area 130. Support wire 228 extends through slot 60 in order to support pinball 230.

Figure 4:
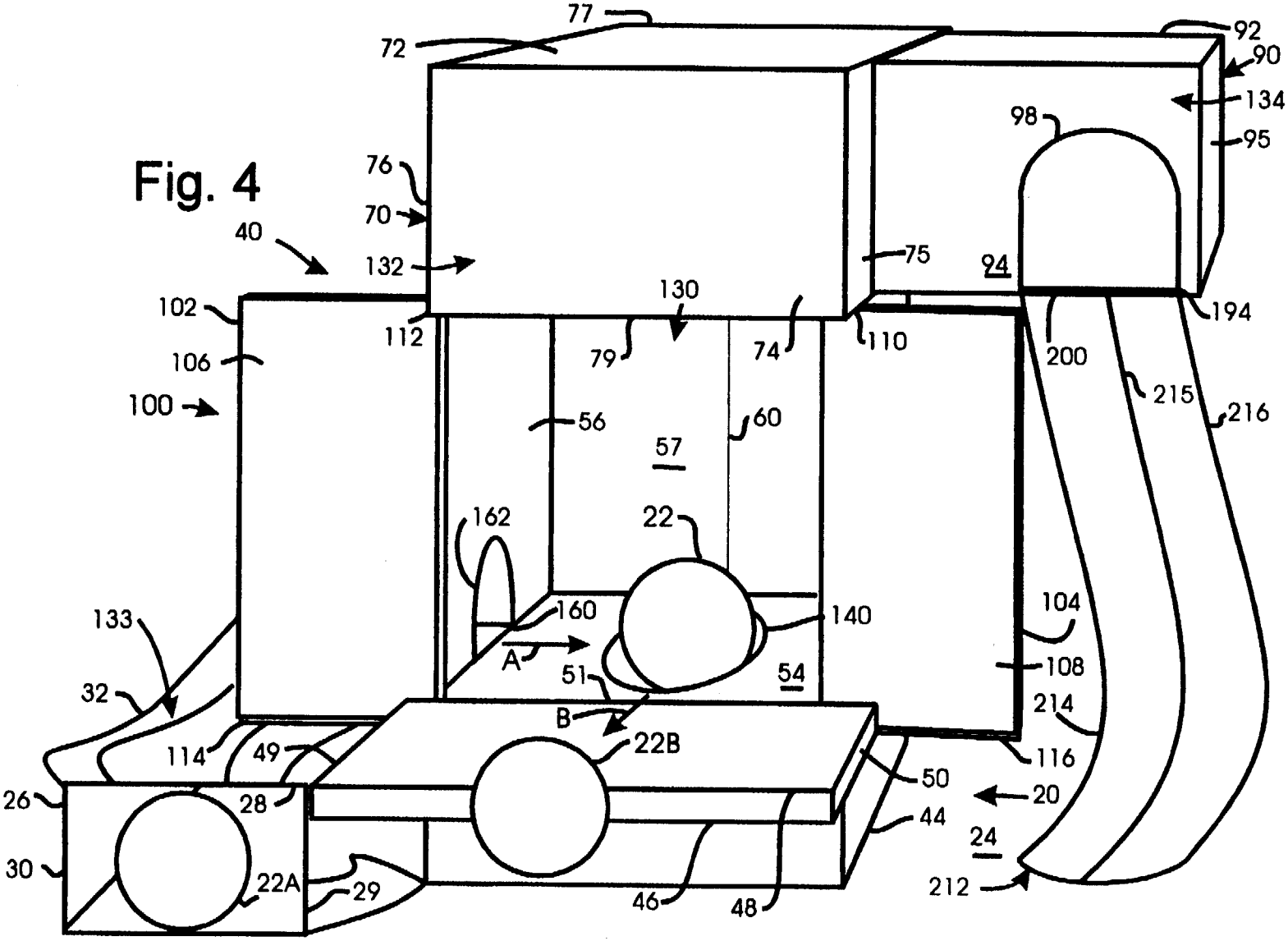
FIG. 4 illustrates the apparatus shown in FIG. 1 with a pinball displayed on the stage during a first operating state.
Figure 5:
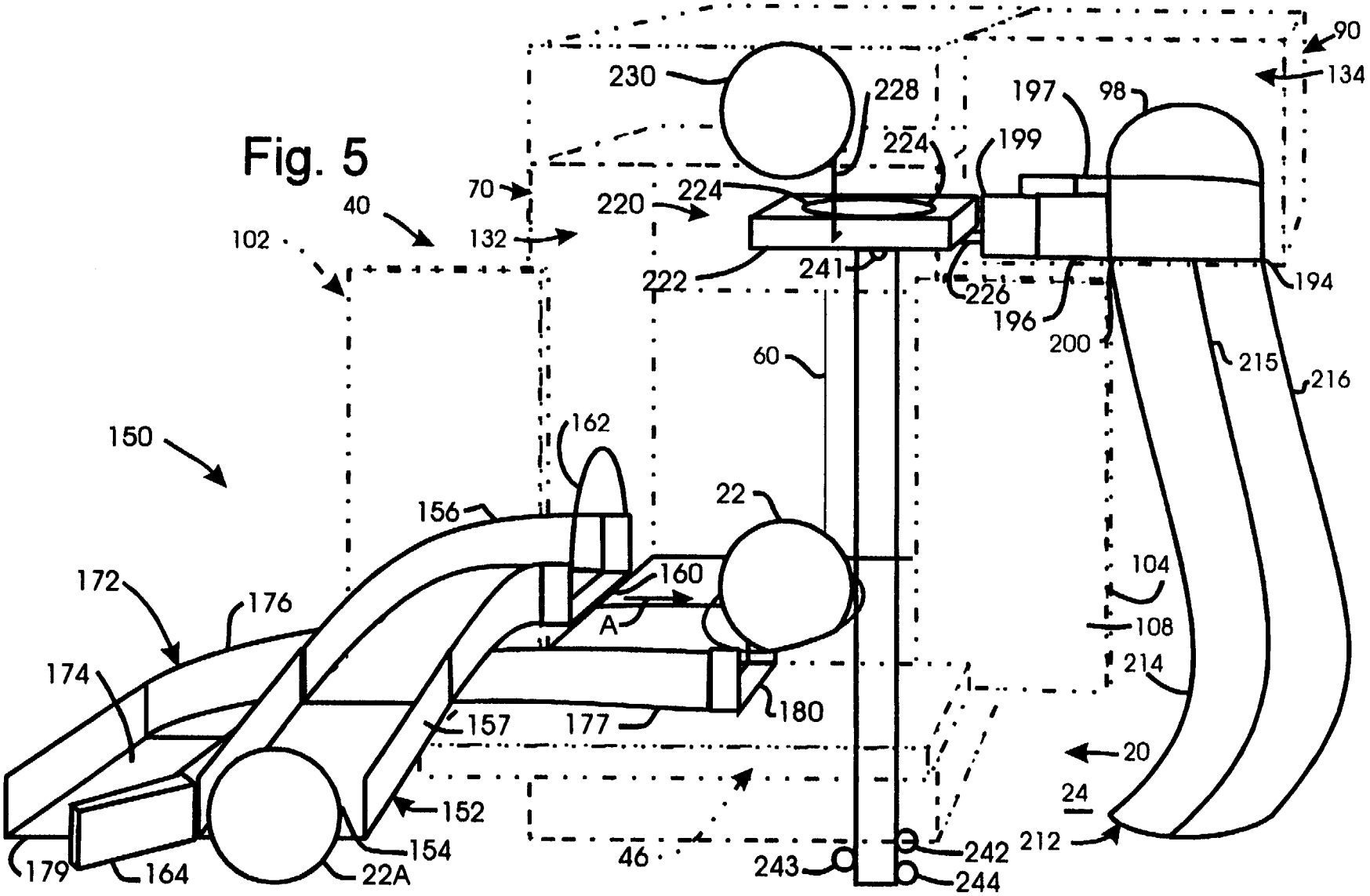
FIG. 5 illustrates the apparatus shown in FIG. 3 illustrating movement of pinballs during the first operating state.

The preferred embodiment includes a first operating state in which the player is encouraged to propel pinball 22 into target 26 (FIG. 1). As shown in FIGS. 4 and 5, during the first operating state, pinball 22 is diverted by diverter 164 into guide 152 and through arch 162 into saucer cup 140. After a predetermined time period of display in cup 140, the pinball is ejected and rolls over surface 48 of proscenium 46 back onto playfield 24. Pinball 22A and arrow A illustrate the progress of pinball 22 as it travels through guide 152 to saucer cup 140 during the first operating state. Pinball 22B and arrow B (FIG. 4) illustrate a typical path of pinball 22 after it is ejected from saucer cup 140.

Figure 6:
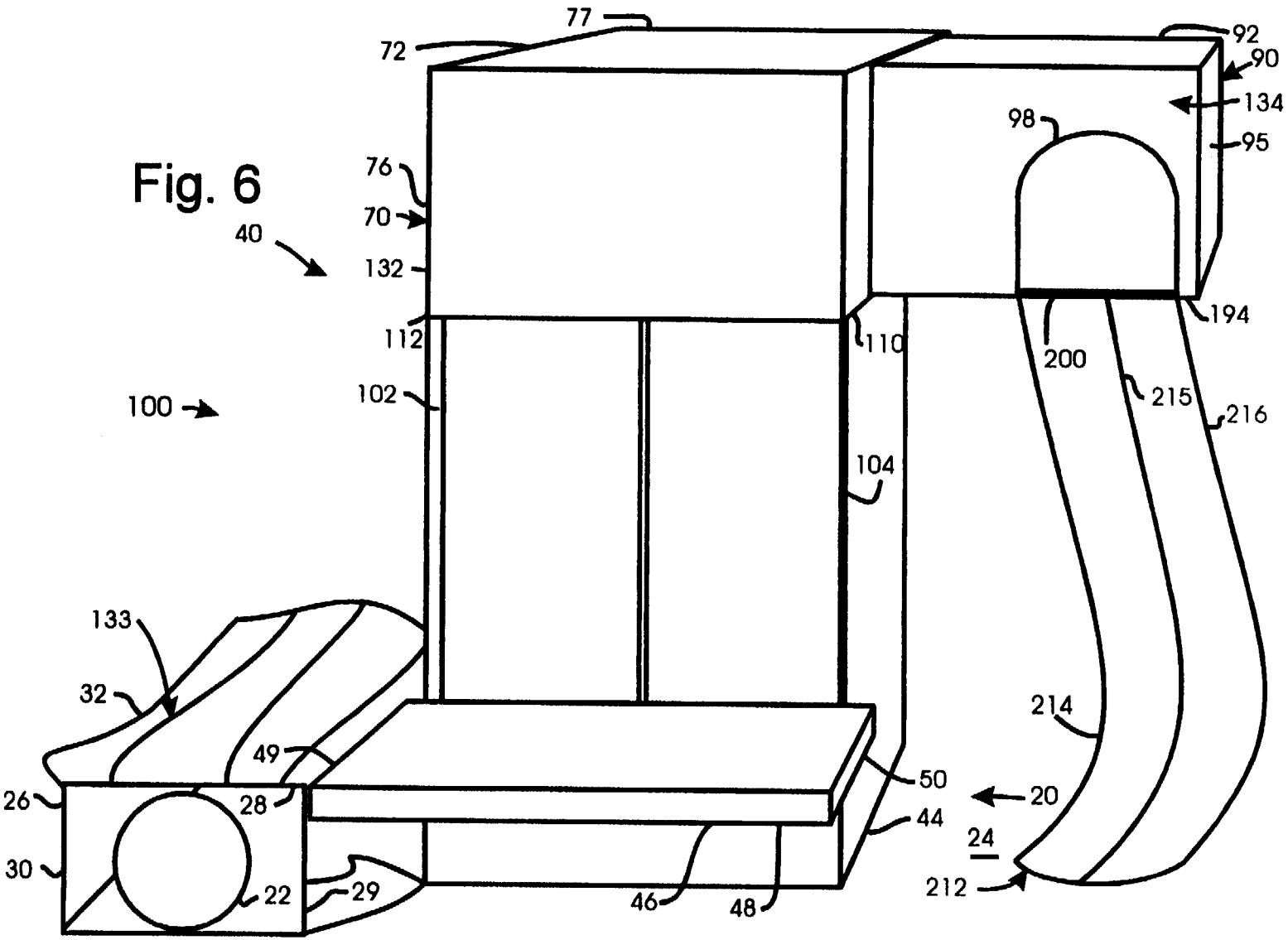
FIG. 6 illustrates the apparatus shown in FIG. 1 with stage screens closed.

After the player has successfully propelled pinball 22 into target 26 a few times during the first operating state, he is conditioned to seeing the pinball roll through arch 162 and into saucer cup 140 in display area 130. Thereafter, a microprocessor controlling operation of the game can illuminate a display panel urging the player to again propel pinball 22 into target 26 in order to obtain bonus points. At this point in time, the game enters a second operating state in which stage screens 102 and 104 are closed as shown in FIG. 6. During the closure of screens 102 and 104, diverter gate 164 is rotated to the position shown in FIG. 7 to divert pinball 22 into guide 172. Guide 172 extends along the surface of playfield 24 to a portion of hidden area 132 located behind wall 57.

Figure 7:
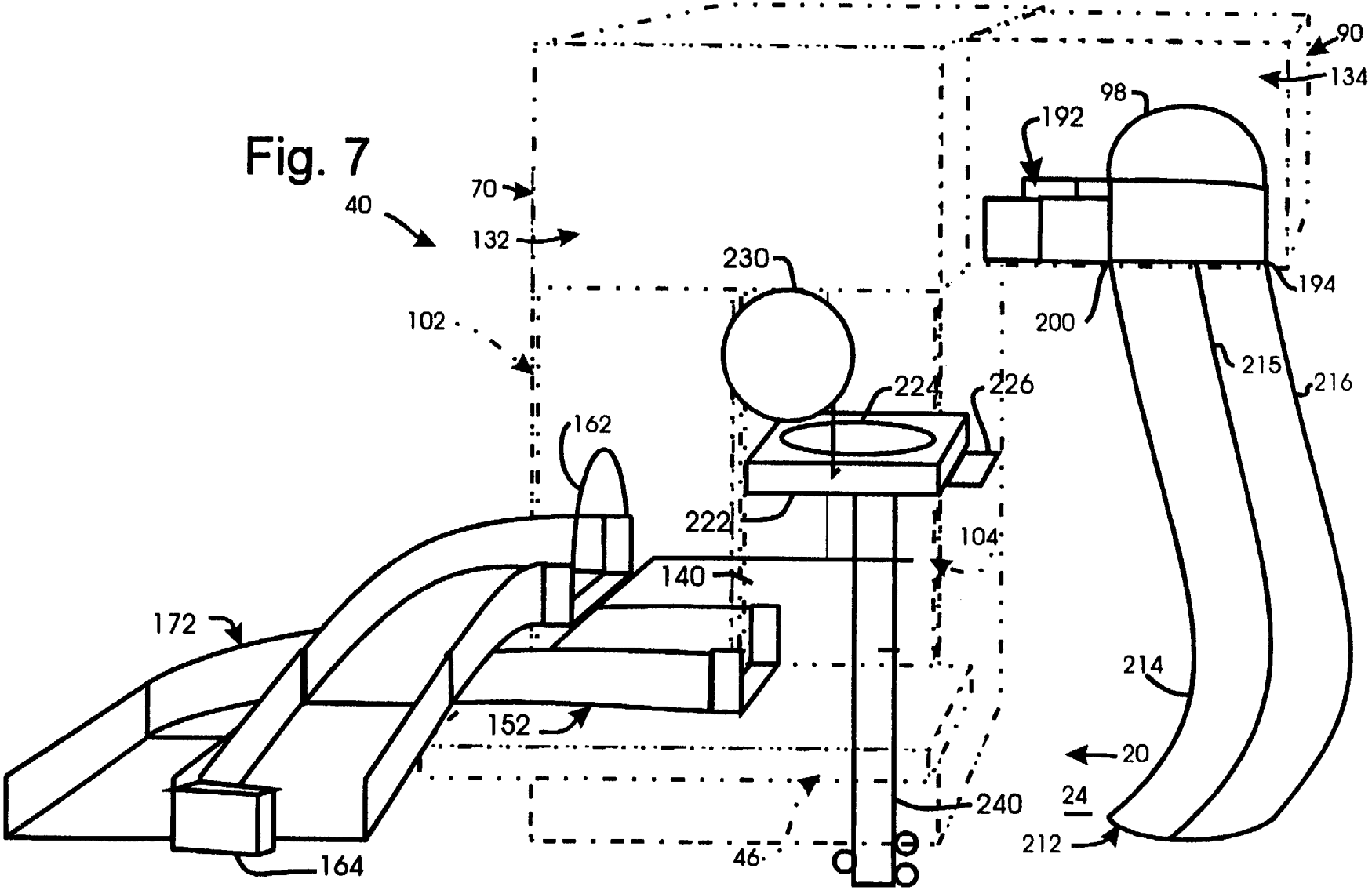
FIG. 7 illustrates the apparatus shown in FIG. 3 with the stage screens closed and a second pinball being moved into the stage area during a second operating state.
Figure 8:
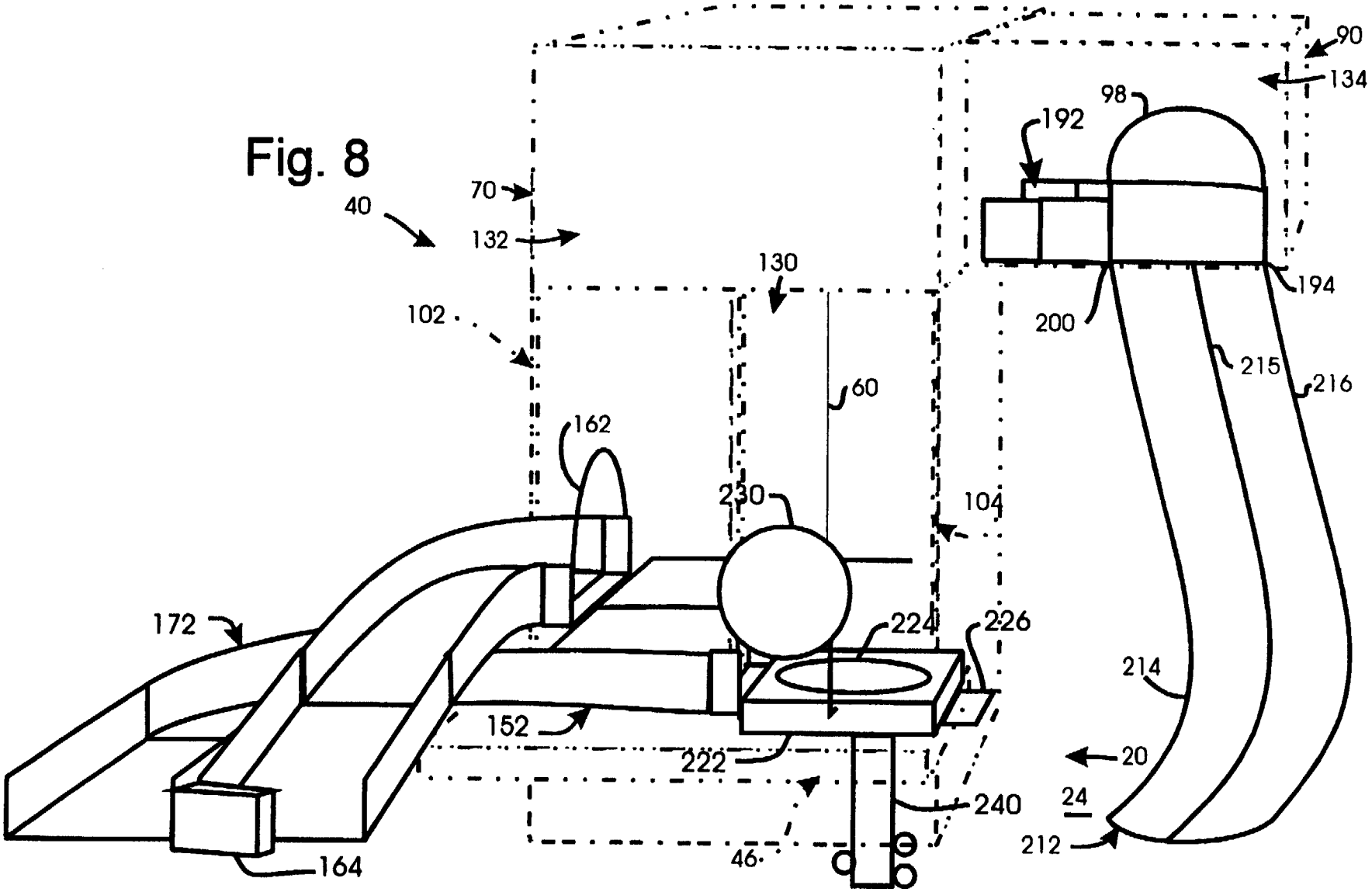
FIG. 8 illustrates the apparatus shown in FIG. 3 with a second pinball fully descended into the stage area during the second operating state.
Figure 9:
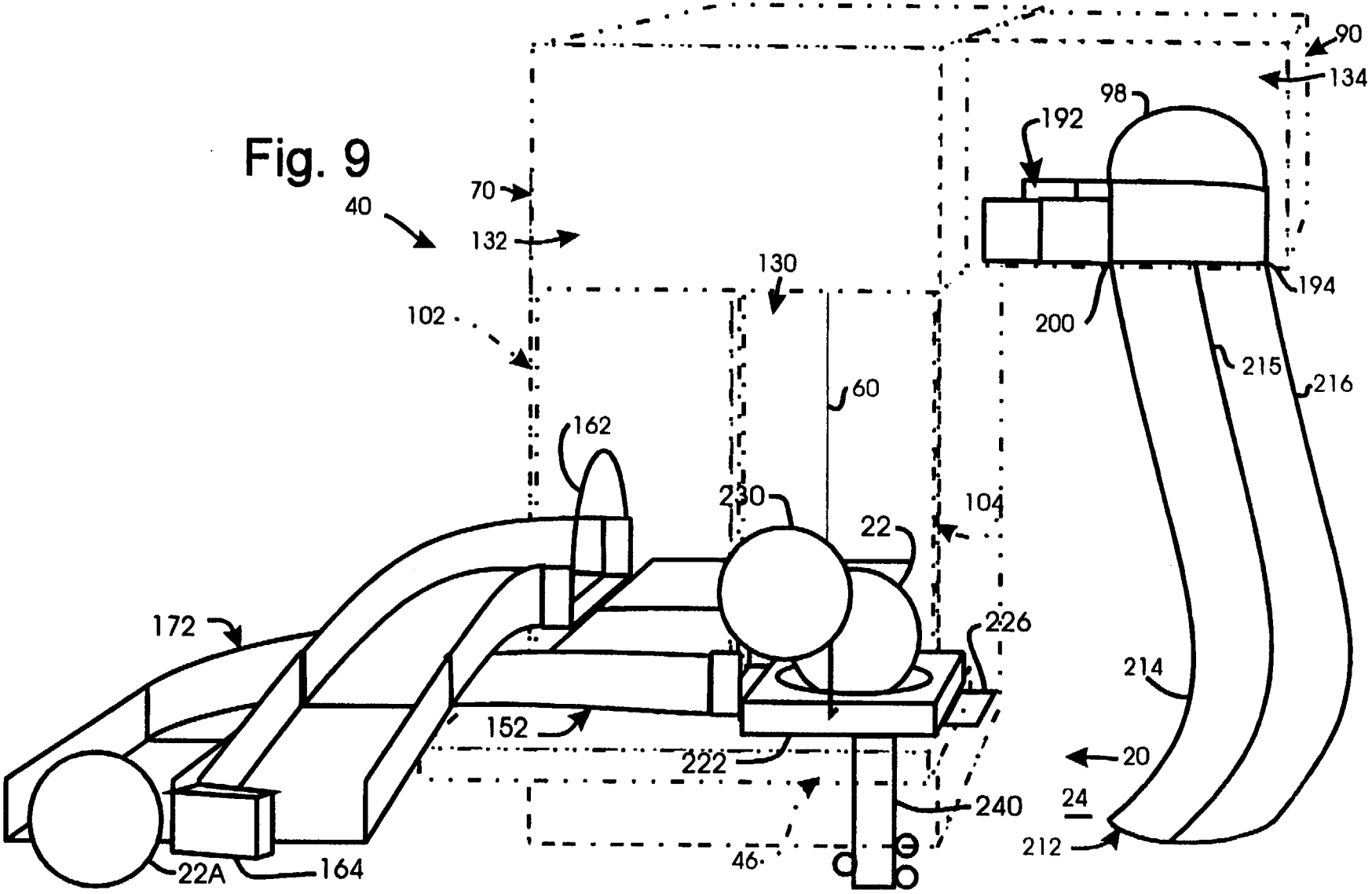
FIG. 9 illustrates the apparatus shown in FIG. 8 with the first pinball located in a hidden area behind the stage and the screens closed.

After screens 102 and 104 are closed, lift assembly 220 descends from loft area 70 as shown in FIG. 7. The lift is lowered due to the operation of pinion gears 242–244 which cause rack gear 240 to descend. (The lower end of gear 240 extends below the view of the drawing and is not shown.) Lift assembly 220 quickly is lowered to the position shown in FIG. 8 in which carriage 222 is aligned with exit end 180 of guide 172 so that pinball 22 emerging from exit end 180 will be received by and held by central cup 224. After lift assembly 220 is fully descended, during the second operating state, if the player successfully propels pinball 22 into target 26, the pinball is guided into cup 224 as shown in FIG. 9. Pinball 22A illustrates the position of pinball 22 at the entrance to guide 172.

Figure 10:
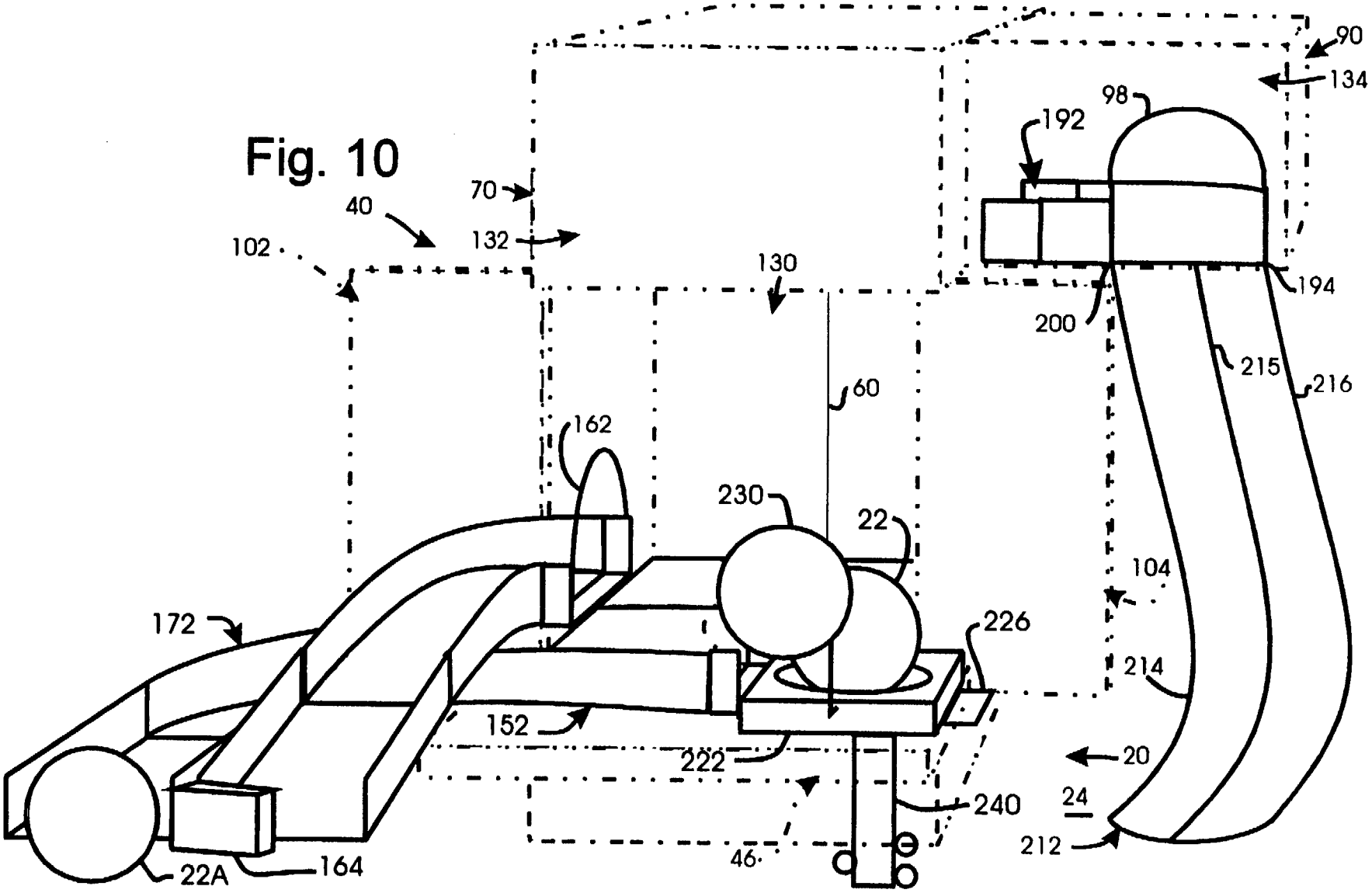
FIG. 10 illustrates the apparatus shown in FIG. 9 with the stage screens open.
Figure 11:
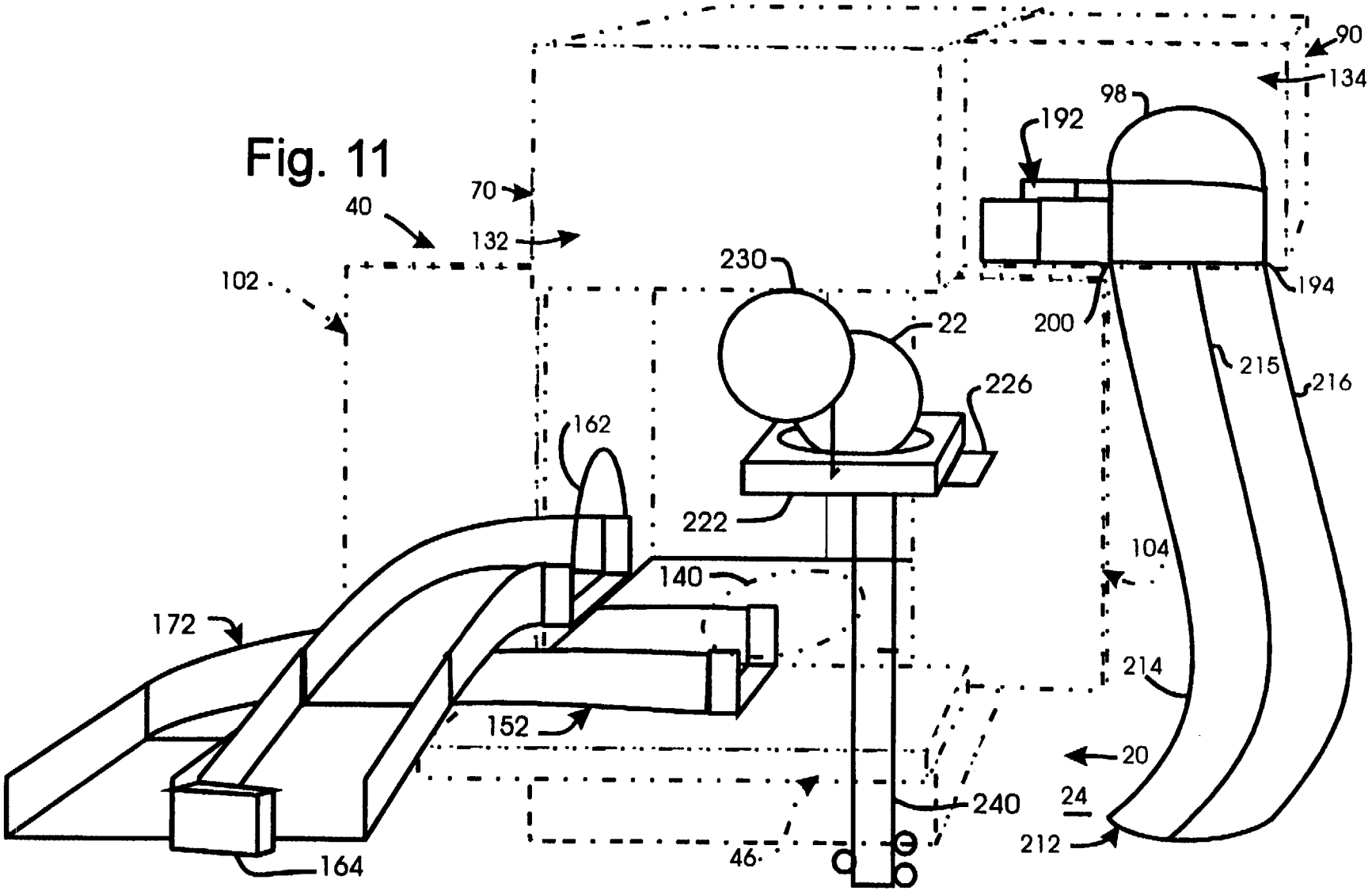
FIG. 11 illustrates the apparatus shown in FIG. 9 but with the screens opened and the second pinball ascending above the stage.

After pinball 22 is in cup 224, screens 102 and 104 are opened as shown in FIG. 10. The real pinball 22 is in cup 224 behind the stage and out of sight. However, the player sees pinball 230 in saucer cup 140 and assumes that it is the real pinball. Thereafter, lift assembly 220 is raised in order to create the illusion that the real pinball is rising out of saucer cup 140 in defiance of the laws of gravity. FIG. 11 illustrates the lift assembly 220 being raised to create the illusion of a floating pinball.

Figure 12:
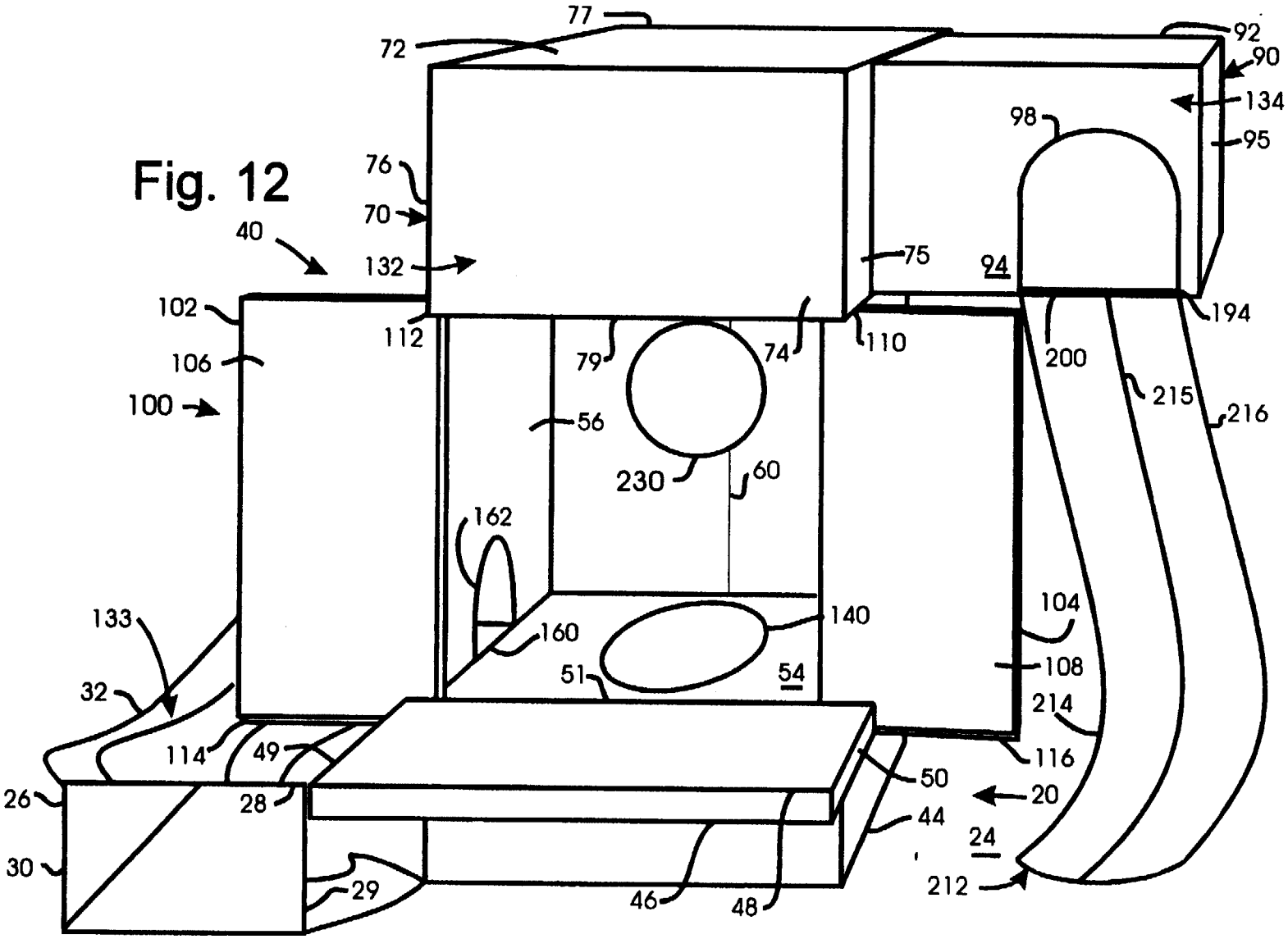
FIG. 12 illustrates the apparatus shown in FIG. 1 with the second pinball ascending above the stage area during the second mode of operation.

FIG. 12 illustrates the stage as seen by the player with pinball 230 ascending.

Figure 13:
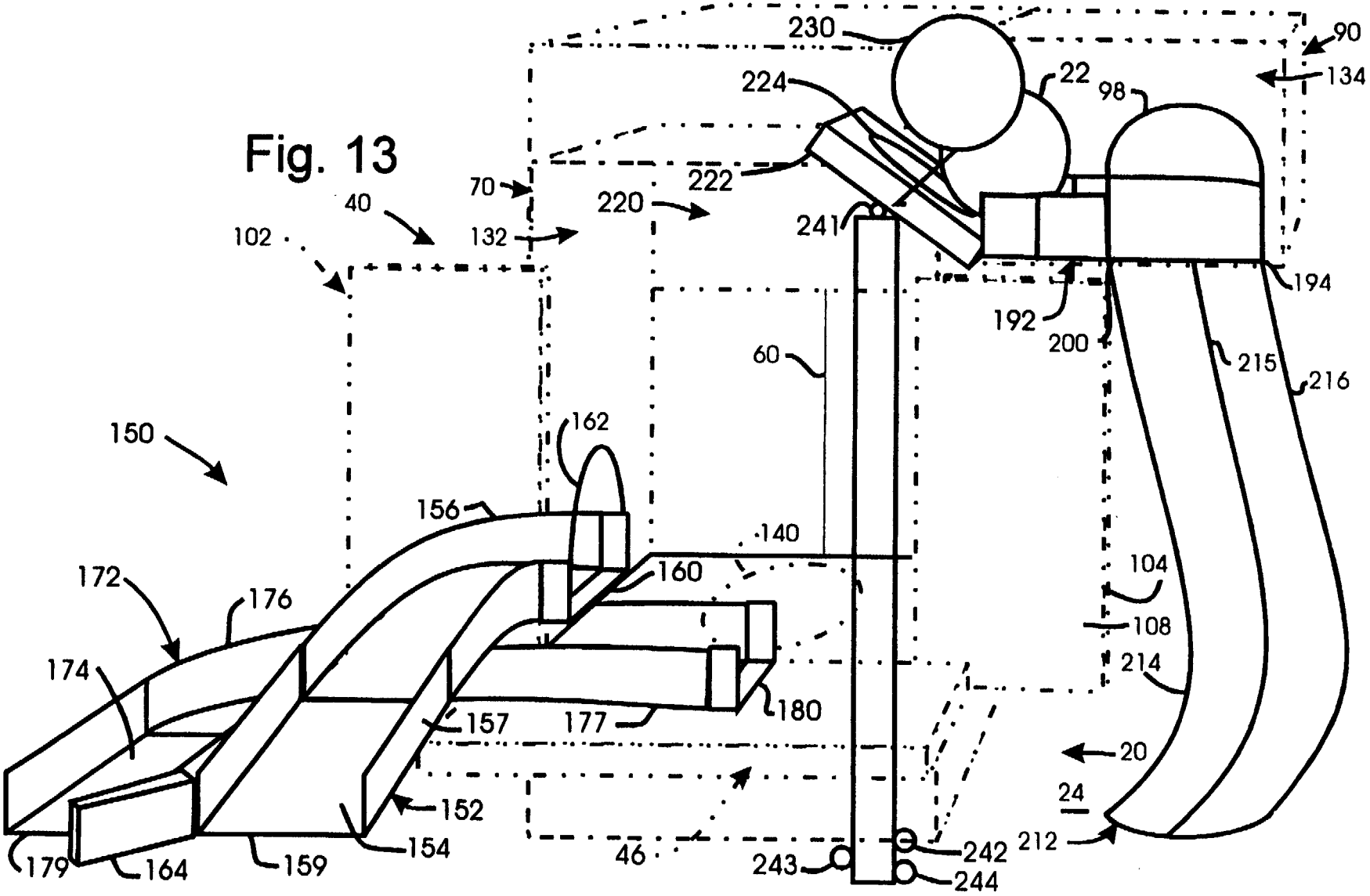
FIG. 13 illustrates the apparatus shown in FIG. 3 in which the second pinball is being guided into a ball guide for return to the playfield.
Figure 14:
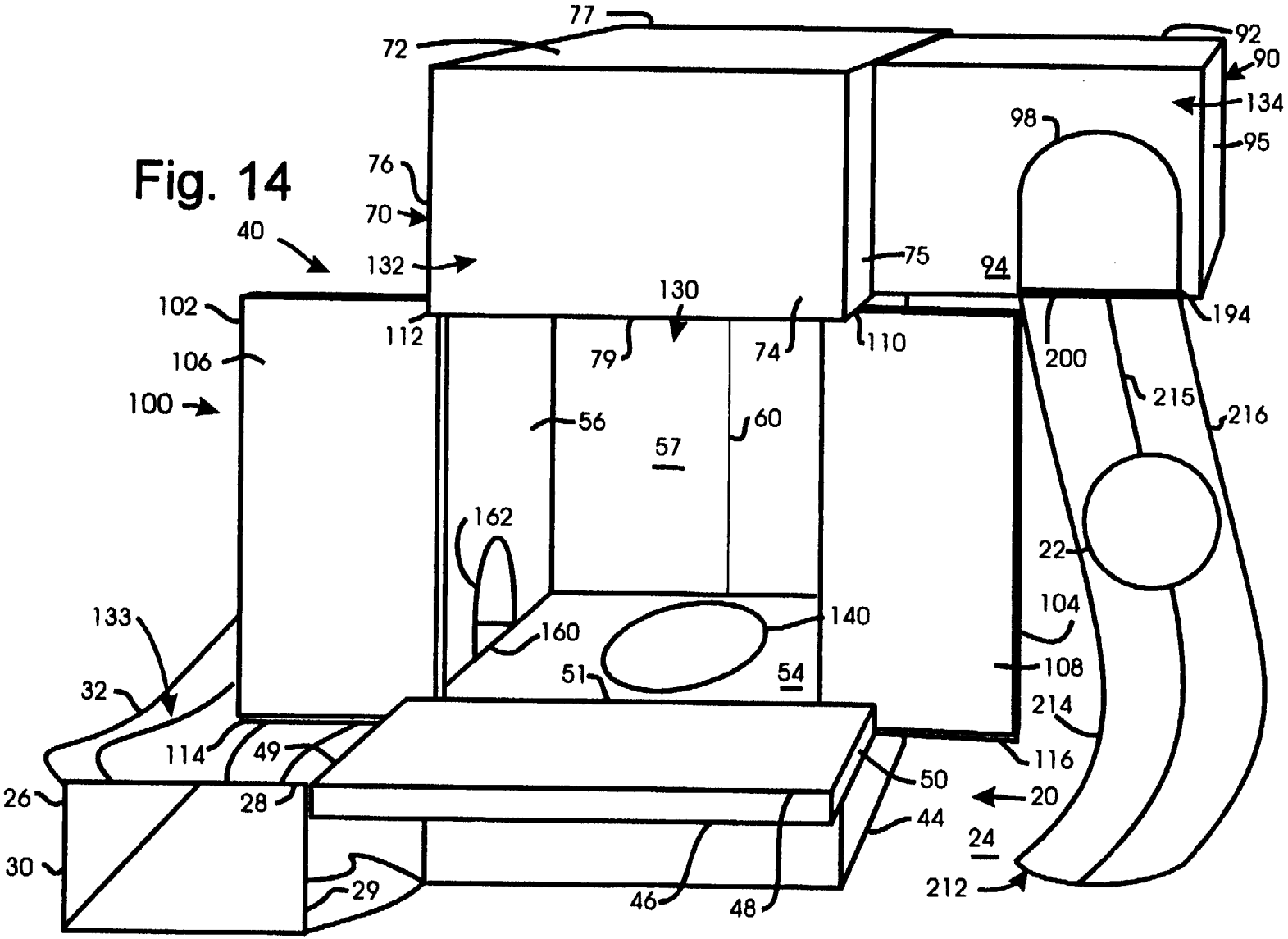
FIG. 14 illustrates the apparatus shown in FIG. 1 in which the first pinball is descending a wire ramp to the playfield.

During the second operating state, when lift 220 is fully ascended, lip 226 strikes the leading edge 199 of guide 192 and is rotated with respect to rack 240 as shown in FIG. 13. As a result, pinball 22 rolls into guide 192 and exits loft extension 90 from opening 98. Thereafter, pinball 22 descends on wire ramp 112 to playfield 24 as shown in FIG. 14.

A microprocessor or other control circuit may be easily programmed by those skilled in the art to control the first and second operation states, the movement of loft assembly 220, screens 102 and 104, diverter gate 164 and saucer cup 140.

Those skilled in the art will recognize that the preferred embodiment may be altered and modified without departing from the true spirit and scope of the invention as defined in the appended claims.

I claim:

1. In a pinball game using a first pinball adapted to be propelled along a pinball game playfield by a player, improved apparatus for creating an optical illusion for said first pinball comprising in combination:

a second pinball;

a target;

a display area of said game visible to said player;

a hidden area of said game concealed from said player;

first means for displaying said first pinball in said display area in response to said player propelling said pinball adjacent said target during a first operating state of said game and for returning said first pinball to said playfield from said display area;

means for moving said first pinball within said hidden area in response to said player propelling said pinball adjacent said target during a second operating state of said game;

second means for displaying said second pinball in said display area and for moving said second pinball from said display area to said hidden area during said second operating state of said game; and means for returning said first pinball to said playfield from said hidden area after said second pinball has been moved to said hidden area during said second operating state of said game, whereby the movement of said second pinball appears to said player to be movement of said first pinball.

2. Apparatus, as claimed in claim 1, wherein said first means for displaying comprises a saucer hole.

3. Apparatus, as claimed in claim 1, wherein said display area comprises a movable closure medium capable of concealing at least a portion of said display area from said player during at least a portion of said second operating state.

4. Apparatus, as claimed in claim 3, wherein said second operating state comprises a first mode in which second means for displaying moves said second pinball into said display area and a second mode in which said second means moves said second pinball within said display area.

5. Apparatus, as claimed in claim 4, and further comprising a closure mechanism for closing said closure medium at least during a portion of said first mode and for opening said closure medium during said second mode.

6. Apparatus, as claimed in claim 3, wherein said display area comprises a stage.

7. Apparatus, as claimed in claim 6, wherein said closure medium comprises a screen or curtain for said stage.

8. Apparatus, as claimed in claim 7, wherein said hidden area comprises a first hidden area located behind said stage and a second hidden area located above said stage.

9. Apparatus, as claimed in claim 8, wherein said means for moving comprises means for guiding said first pinball to said first hidden area and means for carrying said first pinball to said second hidden area after said first pinball has been guided to said first hidden area.

10. Apparatus, as claimed in claim 9, wherein said means for guiding comprises a pinball diverter and a pinball path guide.

11. Apparatus, as claimed in claim 10, wherein said means for carrying comprises a lift.

12. Apparatus, as claimed in claim 11, wherein said lift comprises a rack and pinion.

13. Apparatus, as claimed in claim 11, wherein said second means for displaying comprises a support for said second pinball coupled to said lift.

14. Apparatus, as claimed in claim 1, wherein said means for returning said first pinball to said playfield comprises a pinball guide path.

15. In a pinball game using a first pinball adapted to be propelled along a pinball game playfield by a player, an improved method for creating an optical illusion for said first pinball by using a second pinball, a target, a display area visible to said player and a hidden area concealed from said player, said method comprising in combination the steps of:

displaying said first pinball in said display area in response to said player propelling said pinball adjacent said first target during a first operating state of said game and for returning said first pinball to said playfield from said display area;

moving said first pinball within said hidden area in response to said player propelling said pinball adjacent said target during a second operating state of said game;

displaying said second pinball in said display area and for moving said second pinball from said display area to said hidden area during said second operating state of said game; and returning said first pinball to said playfield from said hidden area after said second pinball has been moved to said hidden area during said second operating state of said game, whereby the movement of said second pinball appears to said player to be movement of said first pinball.

16. A method, as claimed in claim 15, wherein said display area comprises a movable closure medium capable of concealing at least a portion of said display area from said player during at least a portion of said second operating state, wherein said second operating state comprises a first mode in which said second pinball is moved into said display area and a second mode in which said second pinball is moved within said display area.

17. A method, as claimed in claim 16, and further comprising the steps of closing said closure medium at least during a portion of said first mode and opening said closure medium during said second mode.

18. A method, as claimed in claim 15, wherein said display area comprises a stage, wherein said hidden area comprises a first hidden area located behind said stage and a second hidden area located above said stage and wherein said step of moving comprises the step of guiding said first pinball to said first hidden area and the step of carrying said first pinball to said second hidden area after said first pinball has been guided to said first hidden area.

* * * * *